United States Patent [19]

Hofferberth

[11] 4,139,754

[45] Feb. 13, 1979

[54] STATIONARY CONTACT COMBINATION

[75] Inventor: William H. Hofferberth, Finksburg, Md.

[73] Assignee: I-T-E Imperial Corporation, Spring House, Pa.

[21] Appl. No.: 732,976

[22] Filed: Oct. 18, 1976

[51] Int. Cl.[2] ..... H01H 67/02

[52] U.S. Cl. ..... 200/281; 200/284; 335/132

[58] Field of Search ..... 200/143, 281, 282, 284, 200/292, 280; 335/132, 197

[56] References Cited

U.S. PATENT DOCUMENTS

| | | | |
|---|---|---|---|
| 3,164,709 | 1/1965 | Gentile | 200/281 |
| 3,213,255 | 10/1965 | Kussy et al. | 200/243 |
| 3,855,558 | 12/1974 | Hayward | 200/243 |

*Primary Examiner*—Charles T. Jordan
*Assistant Examiner*—Ralph Palo
*Attorney, Agent, or Firm*—Ostrolenk, Faber, Gerb & Soffen

[57] ABSTRACT

A stationary contact of an electromagnetic contactor having an insulating contact mounting plate is part of a contact combination that includes a contact arm, a retainer and a fastening screw for electrically and mechanically securing the contact combination to a terminal of the contactor. The contact is mounted on the forward end of the arm and the retainer, constructed of spring sheet material, engages the rear of the arm. The front of the arm and the retainer cooperate to form a recess which receives and grips a formation of the mounting plate.

6 Claims, 6 Drawing Figures

FIG. 1.
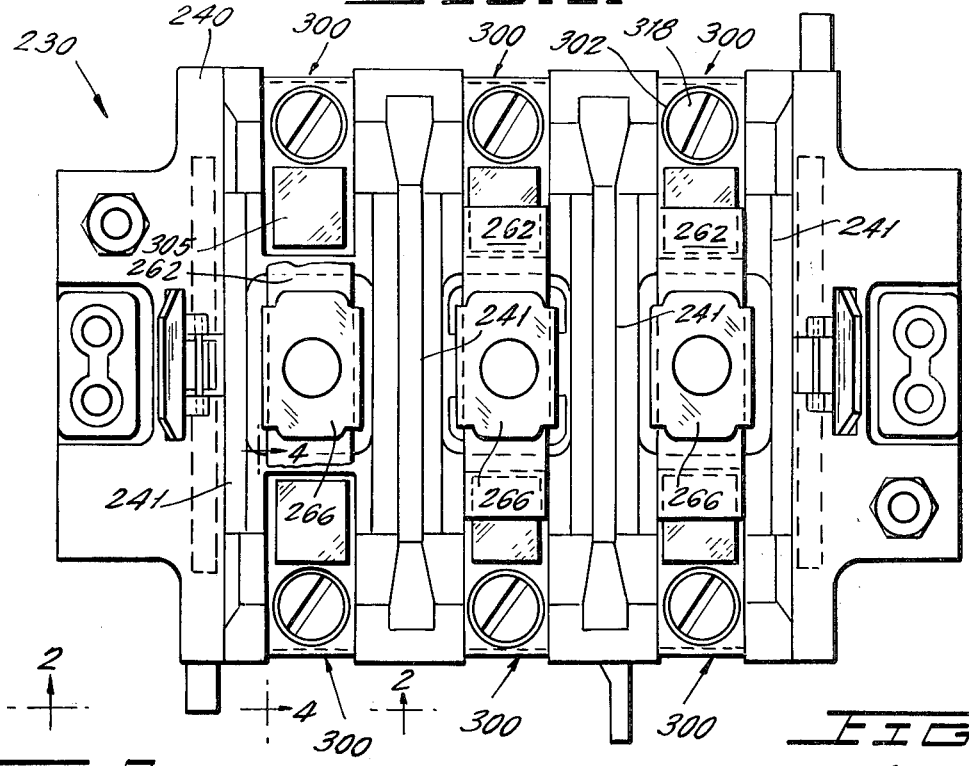
FIG. 2.
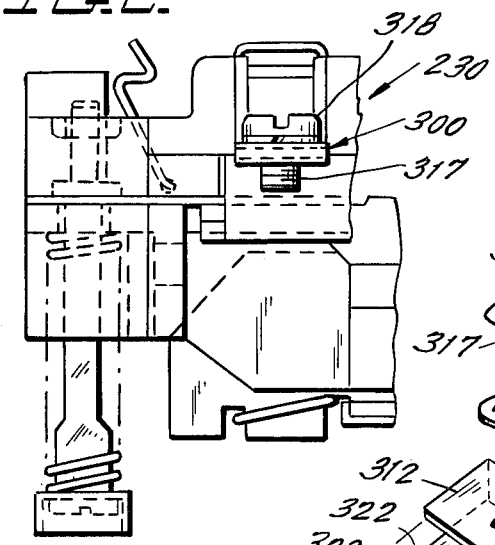
FIG. 3.
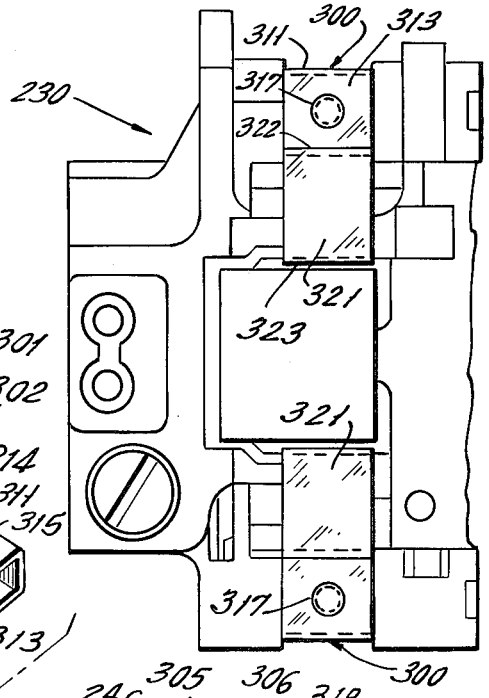
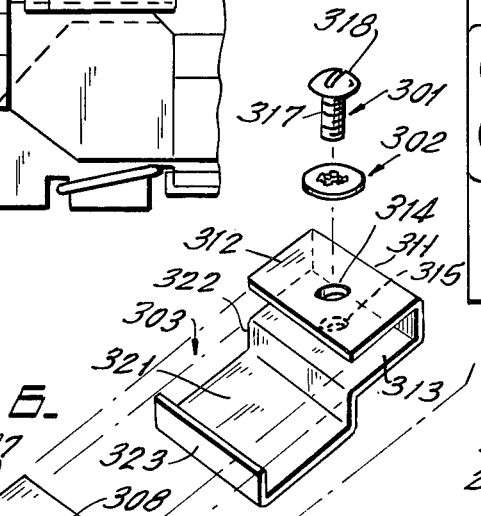
FIG. 6.
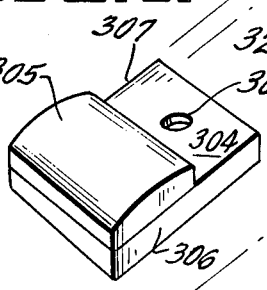
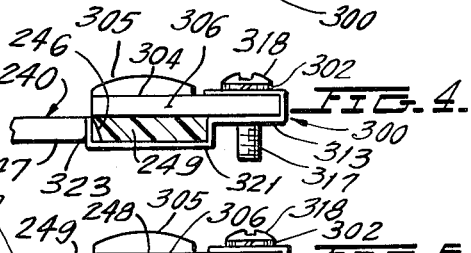
FIG. 4.
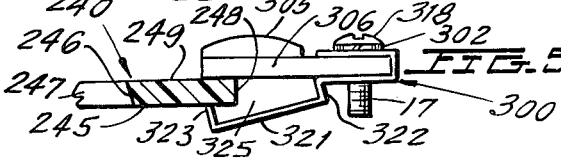
FIG. 5.

STATIONARY CONTACT COMBINATION

This invention relates to a stationary contact combination or particularly relates to a combination of this type which is removably snap-fitted to a contact carrier plate.

U.S. Pat. No. 3,213,255 issued Oct. 19, 1965 to F. W. Kussy et al. for a Stationary Contact Combination Including Resilient Retaining Means discloses a frictionally held contact combination for a contactor of the type described in detail in U.S. Pat. No. 3,324,431 issued June 6, 1967 to J. B. Cataldo et al. for an Electromagnetic Contactor Having Interchangeable Auxiliary Devices.

In a contactor of the type disclosed in the aforesaid U.S. Pat. No. 3,324,431 there is a contact assembly including a plate and a carrier movable relative to one another. The plate carries all of the stationary contacts and the carrier mounts the movable bridging contacts. When it becomes necessary to inspect or replace the coil of the contact operating electromagnet, the contact assembly is removed from the contactor base. This is readily accomplished by operating the fastening means which connect the main contacts in the load circuit. That is, the same screws that mechanically secure the plate of the contactor assembly to the base of the contactor also provide pressure for electrical contact between the stationary contacts on the plate and terminals on the base of the contactor.

Even though it is necessary to break all of the electrical connections between the contact assembly and base of the contactor in order to gain access to the interior of the base, it is desirable to have the stationary contacts remain mounted to the plate of the contact assembly and not completely fall therefrom or be moved from their operative positions. Thus, the instant invention provides a construction in which each stationary contact is mounted on a contact arm which is part of a contact combination. The latter includes a retainer constructed of conducting spring-like sheet material, which engages the contact arm. As will hereinafter be seen, the retainer cooperates with the contact arm to form a recess which receives a mounting portion of the contact plate for securing the contact combination against accidental removal yet facilitating mounting and intentional removal.

Accordingly, a primary object of the instant invention is to provide a novel construction for a contact assembly which facilitates mounting and dismounting thereof on a contact plate, yet prevents accidental dismounting.

Another object is to provide a novel improved contact combination of this type that is removably snap-mounted to a contact plate.

These objects as well as other objects of this invention shall become readily apparent after reading the following description of the accompanying drawings in which:

FIG. 1 is a plan view of a contact carrier assembly including stationary contact combinations constructed in accordance with teachings of the instant invention. In FIG. 1 the bridging contact of the left pole has been removed.

FIG. 2 is a partial end view of the contact carrier assembly looking in the direction of arrows 2—2 of FIG. 1, so as to illustrate an end view of the contact combination.

FIG. 3 is a partial bottom view of the contact carrier assembly of FIGS. 1 and 2.

FIG. 4 is a fragmentary cross-section taken through line 4—4 of FIG. 1 looking in the direction of arrows 4—4 and illustrating a side elevation of the contact combination.

FIG. 5 is a view similar to FIG. 4 showing the contact combination as it is being mounted to the contact plate.

FIG. 6 is an exploded perspective of the contact combination.

Now referring to the drawings and more particularly to FIGS. 4, 5 and 6. Contact combination 300, constructed in accordance with teachings of the instant invention, consists of four separable elements, namely, fastening screw 301, lock washer 302, retainer 303 and stationary contact arm 304 having stationary contact 305 welded or otherwise fixedly secured to the forward section 306 thereof. Rear section 307 of contact arm 304 is provided with clearance aperture 308 for screw 301.

Retainer 303 is constructed of conducting spring material and includes rear portion 311 having parallel arms 312, 313 between which rear section 307 is sandwiched. Apertures 314, 315, through the respective arms 312, 313 are aligned with aperture 308. The threaded portion at the end of screw shank 317 remote from head 318 extends through lock washer 302 and then extends, in order, through apertures 314, 308 and 315. It is noted that aperture 308 is of greater diameter than the outer diameter of the screw thread but that the diameters of apertures 314, 315 are slightly less than the outer diameter of the screw thread so that screw 301 must be threaded onto retainer 303. It is also noted that the portion of shank 317 adjacent to head 318 is undercut.

Retainer 303 also includes front portion 321 connected to rear portion 311 by step 322 so that front 321 is offset in a direction away from the contact arm 306. However, the free end of the forward portion 321 is provided with tab 323 which, for reasons to be hereinafter explained, extends toward contact arm 304.

Contact carrier assembly 230 (FIGS. 1 through 3) includes six stationary contact combinations 300 two for each contactor pole. Three contact combinations are mounted along one edge of contact plate 240 and the other three contact combinations are mounted along the opposite edge of plate 240, in a manner to be hereinafter explained. Ribs 241 divide contact plate 240 into a plurality of parallel channels within which stationary contact combinations 300 are mounted. Assembly 230 also includes movable contact carrier 260 which mounts three bridging contacts 262 and their retainer means 266.

FIGS. 4 and 5 illustrate the mounting of the contact combination 300 to contact plate 240. In the final mounting position of FIG. 4, it is seen that mounting formation 249 of plate 240, extending from edge 248 to aperture 247 thereof and positioned between an adjacent pair of ribs 241, 241, is disposed within recess 325 at the front of contact combination 300. Recess 325 is bounded by the bottom surface of contact arm 304, step 322 of retainer 303, front retainer portion 321 and retainer tab 323.

To mount combination 300, forward portion 321 thereof is deflected away from contact arm 304 until there is a sufficient separation between the free edge of tab 323 and arm 304 to permit contact plate edge 248 to fit therebetween (FIG. 5). Thereafter, combination 300 is moved to the left with respect to FIG. 5 and just before step 322 engages edge 248, tab 323 snaps into aperture 247 so that mounting formation 249 is disposed within recess 325 and is sandwiched between forward retainer portion 321 and forward section 306 of contact arm 304. Thus, it is seen that combination 300 is removably snap-fitted to contact carrier plate 240 of contact assembly 230.

Even though stationary contact combination 300 is mounted so that it will not be dislodged accidentally when contact assembly 230 is separated from the contactor base (not shown), the slight rearward slope to surface 246 at the front of mounting formation 249 facilitates intentional removal of combination 300. That is, to remove combination 300 from plate 240 the rear of combination 300 is grasped and pulled to the right with respect to FIG. 4. As the free edge of tab 323 engages sloping surface 246 front retainer portion 321 deflects away from contact arm 304 thereby permitting the free edge of tab 323 to ride on bottom surface 245 of mounting formation 249.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. A contact combination for an electrical switching device, said combination including a stationary contact arm, a contact positioned at a front section of said arm and mounted on a first surface thereof, an aperture through a rear section of said arm, a retainer constructed of spring metal, said retainer including rear and front portions, said rear portion including spaced arms between which said front section is sandwiched with said aperture in alignment with aperture means of said rear portion, fastening means extending through said aperture and aperture means for connecting said combination in a circuit, said front portion being offset from said rear section in a direction away from a second surface of said arm opposite said first surface, said front portion and said front section cooperating to form a recess therebetween for receiving a mounting formation of a contact carrier for mechanical securing of said combination in operative position on such carrier.

2. A contact combination as set forth in claim 1 in which the recess is also bounded by a tab at the front portion, said tab extending toward said second surface in blocking relationship with a mounting formation of a contact carrier.

3. A contact combination as set forth in claim 1 in which the recess is open at opposite sides thereof, said front portion being deflectable from its normal position in a direction away from said second surface to permit mounting and dismounting of said combination from a contact carrier by providing a front opening for said recess through which the latter is enterable by a contact carrier mounting formation by movement of said retainer in a forward direction relative to a contact carrier.

4. A contact combination as set forth in claim 3 in which the recess is also bounded by a tab at the front protion, said tab extending toward said second surface in blocking relationship with a mounting formation of a contact carrier.

5. A contact combination as set forth in claim 1 in which the front portion is deflectable away from said second surface to permit mounting of said combination to a contact carrier without disassembling said combination or part thereof.

6. A contact combination as set forth in claim 5 in which the recess is also bounded by a tab at the front portion, said tab extending toward said second surface in blocking relationship with a mounting formation of a contact carrier.

* * * * *